US007420434B2

(12) United States Patent
Hoover

(10) Patent No.: US 7,420,434 B2
(45) Date of Patent: Sep. 2, 2008

(54) CIRCULAR TO RECTANGULAR WAVEGUIDE CONVERTER INCLUDING A BEND SECTION AND MODE SUPPRESSOR

(75) Inventor: John C. Hoover, Amelia Island, FL (US)

(73) Assignee: EMS Technologies, Inc., Norcross, GA (US)

( * ) Notice: Subject to any disclaimer, the term of this patent is extended or adjusted under 35 U.S.C. 154(b) by 0 days.

(21) Appl. No.: 11/737,830

(22) Filed: Apr. 20, 2007

(65) Prior Publication Data

US 2008/0186113 A1 Aug. 7, 2008

Related U.S. Application Data

(63) Continuation of application No. PCT/US2007/061511, filed on Feb. 2, 2007.

(51) Int. Cl.

| | |
|---|---|
| ***H01P 1/16*** | (2006.01) |
| ***H01P 1/162*** | (2006.01) |
| ***H01P 1/02*** | (2006.01) |
| ***H01P 5/02*** | (2006.01) |

(52) U.S. Cl. ..... 333/21 R; 333/35; 333/249; 333/251

(58) Field of Classification Search ..... 333/249, 333/251, 35, 21 R

See application file for complete search history.

(56) References Cited

U.S. PATENT DOCUMENTS

| | | | | |
|---|---|---|---|---|
| 2,706,278 | A * | 4/1955 | Walker | 333/249 |
| 4,344,053 | A * | 8/1982 | Anderson | 333/251 |
| 4,564,826 | A | 1/1986 | Wiesenfarth et al. | |
| 4,679,008 | A | 7/1987 | Irzinski et al. | |
| 4,885,839 | A | 12/1989 | Ben-Dov | |
| 5,151,673 | A * | 9/1992 | Waarren | 333/249 |
| 5,202,650 | A | 4/1993 | Krill et al. | |
| 5,374,938 | A | 12/1994 | Hatazawa et al. | |
| 5,719,976 | A | 2/1998 | Henry et al. | |
| 6,023,209 | A | 2/2000 | Faulkner et al. | |

OTHER PUBLICATIONS

PCT/US07/61511, International Search Report, Feb. 6, 2008, 1 page.

* cited by examiner

*Primary Examiner*—Benny Lee
(74) *Attorney, Agent, or Firm*—King & Spalding LLP

(57) ABSTRACT

A compact circular waveguide system can connect circular waveguides through a bend while avoiding excessive interaction between the orthogonal modes of the circular waveguides. A compact bend system with circular waveguide input and output can be achieved by providing short quarter wave transformers. The quarter wave transformers can be positioned at the transitions between the circular waveguides and a single-mode quasi-rectangular waveguide segment. Within the single-mode quasi-rectangular waveguide segment, a bend can be formed without concern for mixing of the orthogonal modes of the circular guided wave. The undesired mode of propagation can be substantially reduced or eliminated within the quarter wave transformers with a resistive mode suppressor. The compact system can be machined out of a single block of material from the outside flange faces.

20 Claims, 8 Drawing Sheets

CIRCULAR TO RECTANGULAR WAVEGUIDE CONVERTER INCLUDING A BEND SECTION AND MODE SUPPRESSOR

STATEMENT REGARDING PRIORITY AND RELATED APPLICATIONS

This application is a continuation of and claims priority under 35 U.S.C. §120 and 35 U.S.C. 365(c) to application International Application Serial No. PCT/US2007/61511 filed Feb. 2, 2007, entitled "Circular Waveguide E-Bend," the entire contents of which are incorporated by reference.

TECHNICAL FIELD

The invention is generally directed to circular waveguides for the propagation of electromagnetic energy or signals. The invention relates more specifically to achieving, with high manufacturability, compact bends in circular waveguides for the interconnection of RF (radio frequency) components.

BACKGROUND OF THE INVENTION

An electromagnetic waveguide is a structure for conducting electromagnetic waves. Typically these waveguides are rectangular in cross-section, rigid, and constructed of conductive material. Such a waveguide generally serves as an interconnect from one RF component or source to another RF component or load. One example system where components are typically interconnected using waveguides is in communication satellites.

Achieving sufficient RF power in satellite communication systems may require operating power amplifiers, such at TWT (traveling wave tube) systems, in parallel. When operated in parallel, the signals from multiple TWTs may require phase and amplitude adjustments in order to be combined coherently. One technique for achieving the required phase shifting and amplitude attenuation is based on Fox type phase shifters and rotary vane attenuators. Internally, these components generally use circular waveguides. Size limitations in satellite applications often demand interconnecting the Fox type phase splitter and the rotary vane attenuator with circular waveguides.

Traditional circular waveguides operate sufficiently for interconnecting Fox type phase shifters and rotary vane attenuators if the components are connected in a straight line or end-to-end. However, the size limitations mentioned above also create a desire to bend the waveguides and effectively fold the circuit into a more compact assembly. Unfortunately, placing a bend into a circular waveguide can introduce problems.

Circular (or even square) waveguides differ from conventional rectangular waveguides in that two orthogonal modes or polarizations can propagate within the circular (or square) waveguide. Bends or discontinuities in the waveguide can cause coupling between these two orthogonal modes causing degradation of the desired signal.

Furthermore, bent waveguides are generally complex to manufacture requiring casting or split machining followed by brazing. Such manufacturing techniques require considerable material handling, and multiple additional steps such as brazing the segments of the waveguide together and final clean-up machining to form the waveguide bend.

In light of the complications and limitations introduced by attempts to form bends in compact circular waveguides, there is a need for a circular waveguide that is both compact and able to propagate radio frequency waves around a bend without excessive signal degradation. Furthermore, there is a need to manufacture such a compact circular waveguide as quickly and as simply as possible. As such, there is a need for a circular waveguide bend that can be machined from a single piece of metal stock with the tool, such as an end mill cutter, entering the piece only from the flange ends.

SUMMARY OF THE INVENTION

The inventive circular waveguide bend can interconnect two circular waveguides through a bend and can avoid excessive interaction between the orthogonal modes or polarizations of the circular waveguides. The compact E-plane bend with circular waveguide input and output ports can be achieved, when transmission of only one polarization is required, by providing short quarter wave transformers. The quarter wave transformers can be positioned at the transitions between the circular waveguides and a single-mode quasi-rectangular waveguide segment. Within the single-mode quasi-rectangular waveguide segment, a bend can be formed without concern for mixing of the orthogonal modes of the circular guided wave. The undesired mode rejection within the quarter wave transformers can be aided by the placement of a resistive mode suppressor.

The inventive circular waveguide bend can be machined from the outside flange faces using a single piece of metal stock. The inventive circular waveguide bend can provide excellent RF propagation/loss performance, impedance matching, and a substantially flat frequency response. Achieving this performance may require that the geometries within the bend be optimized for a given application and frequency band. Optimizations can be established using High Frequency Structure Simulator (HFSS) or other electromagnetic simulation software.

DETAILED DESCRIPTION OF EXEMPLARY EMBODIMENTS

The invention can include various embodiments, examples of which are described below. One exemplary embodiment can include an E-plane bend between two circular waveguides. Another exemplary embodiment can include an H-plane bend between one circular waveguide and one rectangular wave guide. Other exemplary embodiment can include an E-plane bend between one circular waveguide and one rectangular wave guide as well as a non-bent adapter for coupling a circular waveguide to a traditional rectangular waveguide. Other combinations of straight adapters, E-bends, and H-bends with circular, rectangular, or other waveguide interfaces are not beyond the scope or spirit of the invention.

Figure 1:
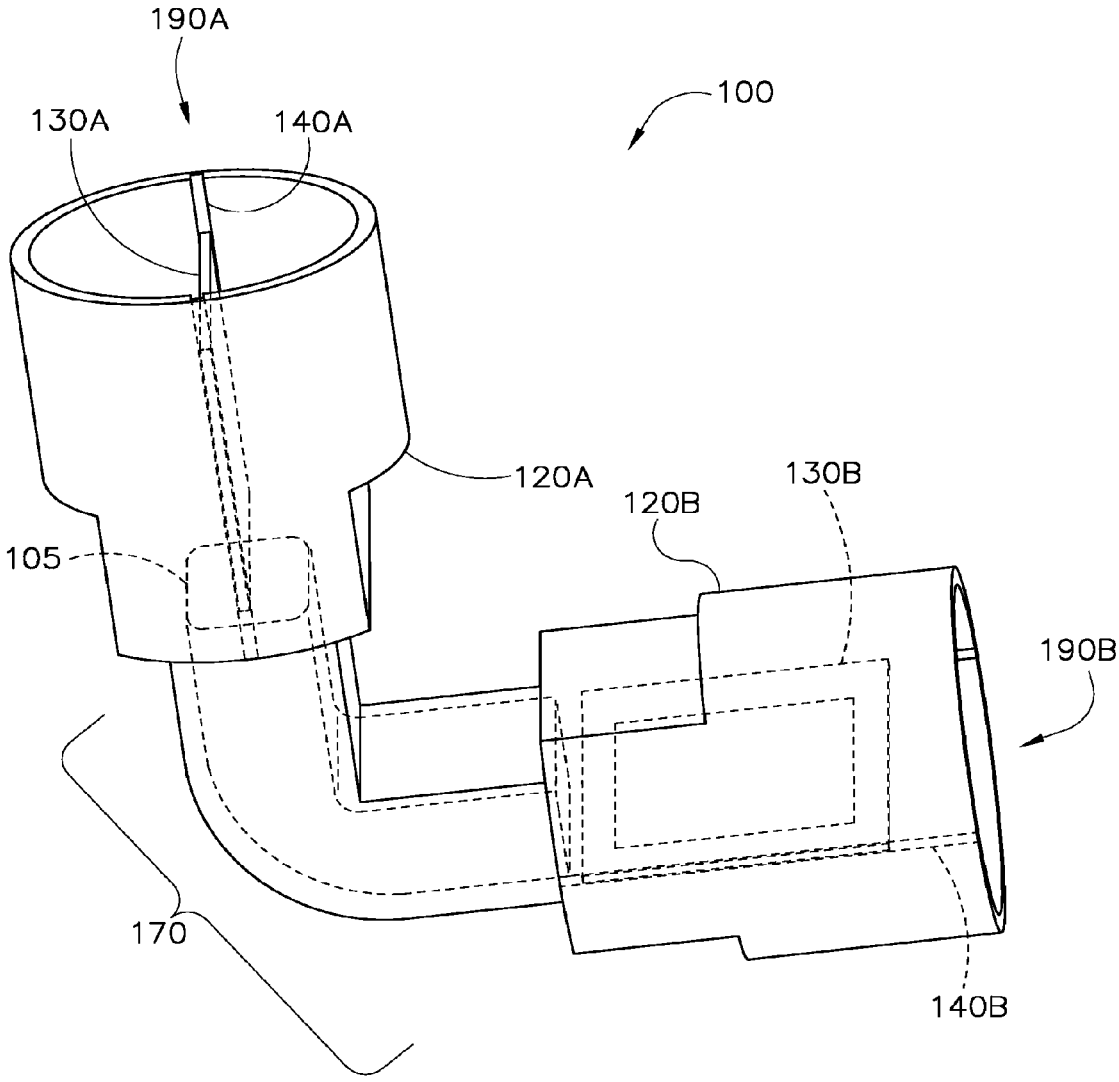
FIG. 1 illustrates a circular waveguide E-bend supporting the interconnection of two circular waveguides according to one exemplary embodiment of the invention.

Turning now to the drawings, in which like reference numerals refer to like elements, FIG. 1 illustrates a circular waveguide E-bend supporting the interconnection of two circular waveguides according to one exemplary embodiment of the invention. A first circular waveguide (not illustrated) can be coupled to the circular waveguide E-bend 100 at a first interface port 190A of the circular waveguide E-bend 100. A second circular waveguide (not illustrated) can be coupled to the circular waveguide E-bend 100 at a second interface port 190B of the circular waveguide E-bend 100. The interface ports 190A, 190B can be flanges, screw flanges, rotational couplings, or some other mechanism for the interconnection of circular waveguides.

The transformer sections 120A, 120B couple to the circular waveguides interfaced to the circular waveguide E-bend 100 at the interface ports 190A, 190B. The transformer sections 120A, 120B couple the circular waveguides to the single-mode segment 170 of the circular waveguide e-bend 100. Since there can be an impedance mismatch between a circular waveguide and the single-mode segment 170, the transformer sections 120A, 120B can be considered compact quarter-wavelength transformer elements or impedance matching transformers. Typically, the characteristic impedance of such a quarter wave transformer can be the geometric mean of the impedance of the two interconnected waveguides to substantially remove the impedance mismatch. In a more complex structure, the exact geometries of the quarter wave transformer 120 can also be optimized using High Frequency Structure Simulator (HFSS) or other electromagnetic simulation software.

Within the single-mode segment 170, an RF wave can be guided through cavity 105. The geometry of the single-mode segment 170 is such that only a single fundamental transverse electric mode of wave propagation is substantially supported. Since the signal within cavity 105 is single-mode, the guided wave can be bent without concern for coupling or combining of energy between multiple modes, as there is substantially only one mode of propagation. The bend in the single-mode segment 170 can bend the E-plane, or plane of the electric field, of the propagated electromagnetic wave. One of ordinary skill in the art will appreciate that an E-bend in a waveguide is such that the narrower side of the waveguide can remain in the same plane through the bend. In other words, the magnetic plane of the wave can remain within the same plane throughout the bend while the electric plane can be bent.

Since a circular waveguide can support two orthogonal modes of propagation while the single-mode segment 170 only supports one mode, the transformer sections 120A, 120B can function to couple the desired single mode of propagation from the circular waveguide to the single mode of propagation within the single-mode segment 170. A resistive mode suppressor 130A, 130B within the transformer section 120A, 120B can aid in suppressing the undesired mode of propagation within the circular waveguide. The undesired mode of propagation may generally be orthogonal to the desired mode. Suppression of the undesired mode of propagation can provide for energy within the single mode segment 170 to couple predominantly with the desired mode within the circular waveguides. Longitudinal channels 140A, 140B within transformer sections 120A, 120B can be provided to position or align the mode suppressors 130A, 130B within the transformer sections 120A, 120B of the circular E-bend waveguide 100.

The exact geometries of the circular waveguide E-bend 100 are selected to provide a compact structure that can be machined from a single piece of metal stock from the outside using a common tool such as an end mill cutter. The exact geometries can also be optimized using High Frequency Structure Simulator (HFSS) or other electromagnetic simulation software to achieve excellent propagation/loss performance, impedance matching, and a substantially flat frequency response.

The circular waveguide E-bend 100 can be machined from a single piece of metal stock. The stock can be any type of metal or alloy such as brass, copper, silver, or aluminum. Generally, a metal with low bulk resistivity is desirable in waveguide applications. The circular waveguide E-bend 100 could also be machined from any material (even a plastic) that can be plated with a metal such as brass, copper, silver, or aluminum.

Bidirectional operation of the circular waveguide E-bend 100 can be supported due to symmetry and electromagnetic reciprocity. RF waves can propagate from interface port 190A to interface port 190B or the opposite direction from interface port 190B to interface port 190A.

Figure 2:
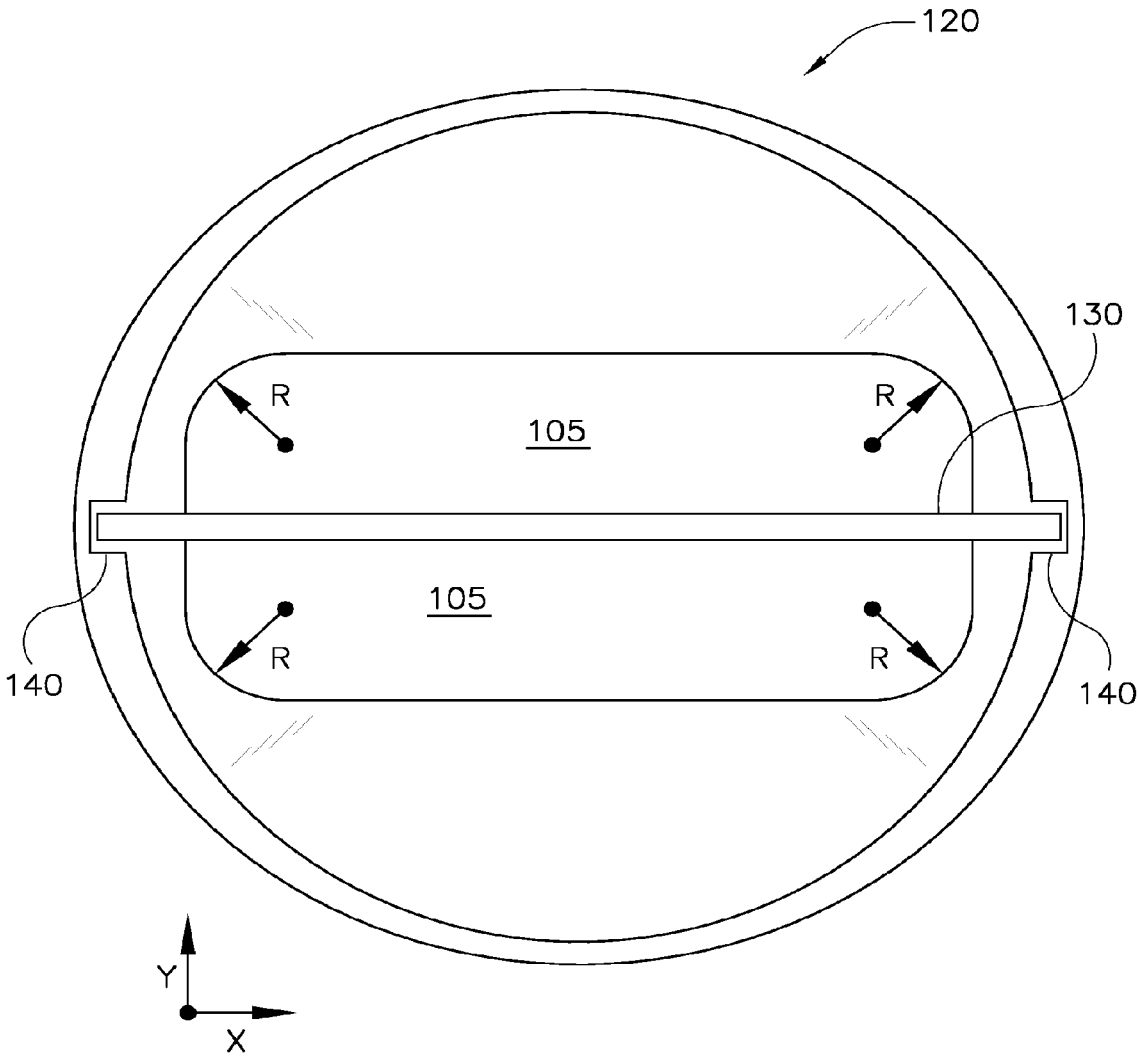
FIG. 2 illustrates a view into the flange end of a transformer section of a circular waveguide E-bend according to one exemplary embodiment of the invention.

Referring now to FIG. 2, the figure illustrates a view into the flange end of a transformer section of a circular waveguide E-bend according to one exemplary embodiment of the invention. The transformer section 120 can function to couple the dominant mode of propagation (vertical direction Y relative to reference numeral orientation in FIG. 2) within the circular waveguide into the single-mode cavity 105 while suppressing the undesired orthogonal mode (horizontal direction X relative to reference numeral orientation in FIG. 2) into the resistive mode suppressor 130. The single-mode cavity 105 can be quasi-rectangular in order to function substantially similar to a traditional single-mode waveguide, however the corners are not sharp but have substantial radii R to allow machining from the outside flange face using a tool such as an end mill cutter or a ball end mill. Additionally, the largest diameter of the single-mode cavity 105 can be smaller then the diameter of the circular waveguide to allow for the machining of the single-mode cavity 105 from the outside of the piece.

The illustrated view into the transformer section 120 shows that the transformer section 120 can function to mechanically taper the circular waveguide down into the single-mode cavity 105. The geometry of the transformer section 120 can support both the mechanical tapering to interconnect the circular waveguide to the single-mode cavity 105 and the electromagnetic impedance matching between the two by serving as a quarter-wave impedance matching transformer. Furthermore, the addition of the resistive mode suppressor 130 can allow the transformer section 120 to also support the substantial attenuation of the undesired orthogonal mode. The resistive mode suppressor 130 can be positioned or aligned within channels 140 provided within the transformer section 120

Figure 3:
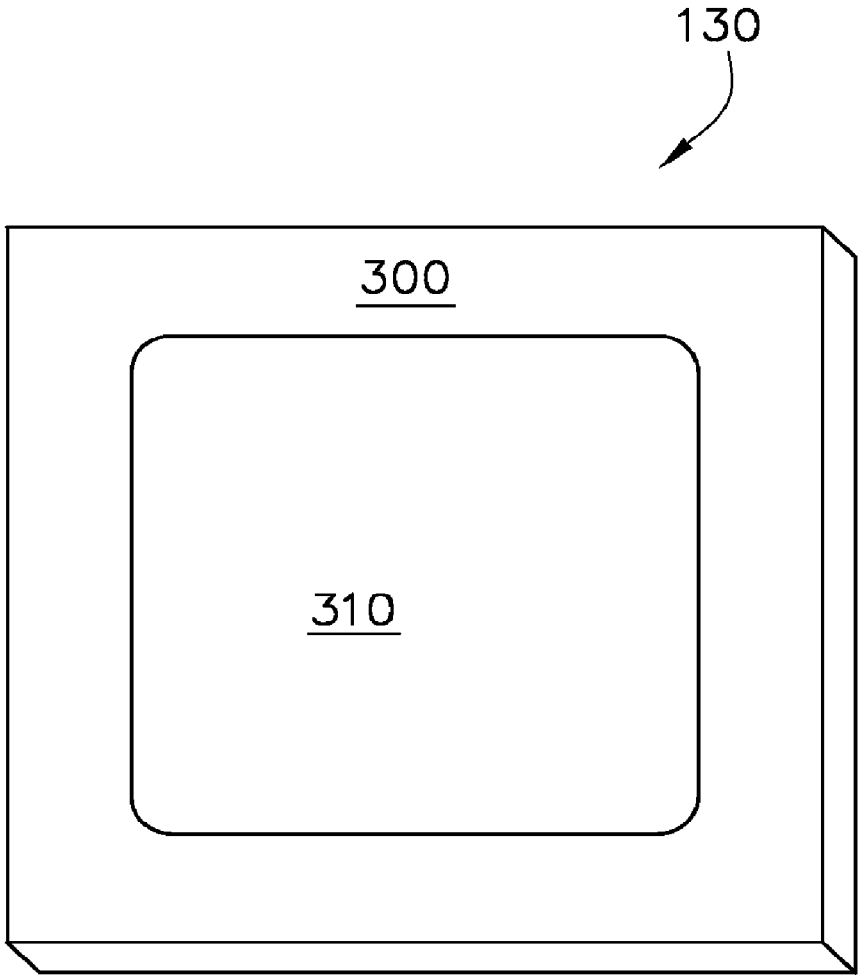
FIG. 3 illustrates a plan view of a resistive mode suppressor for use within a transformer section of a circular waveguide E-bend according to one exemplary embodiment of the invention.

Referring now to FIG. 3, the figure illustrates a plan view of resistive mode suppressor for use within a transformer section of the circular waveguide E-bend 100 of FIG. 1 according to one exemplary embodiment of the invention. The resistive mode suppressor 130 can be a resistor, or resistive card formed from a non-conductive, or dielectric, sheet 300 supporting a resistive film 310. An exemplary material for the non-conductive sheet 300 can be Mylar with a thickness of 0.010 inches. Similarly, the non-conductive sheet 300 can be formed from any non-conductive film, sheet, or plate such as glass, polymer, pvc, plastic, paper, resin, or otherwise. The resistive film 310 can be evaporated, painted, deposited, grown on, or otherwise applied to the non-conductive sheet 300. As one, non-limiting example, the resistive film 310 can be deposited onto the non-conductive sheet 300 at a resistance of 377 ohms/square. Other resistance densities or non-uniform resistance patterns can be used without departing from the scope or spirit of the invention. Likewise, the non-conductive sheet 300 and the resistive film 310 can be combined into a single element using bulk resistive material, a rigid resistive vane, or an impregnated resistive material, for examples.

The resistive mode suppressor 130 can be positioned within the transformer section 120 of circular waveguide E-bend 100 to aid in suppressing the undesired mode of propagation within the circular waveguide that is orthogonal to the desired mode.

Figure 4:
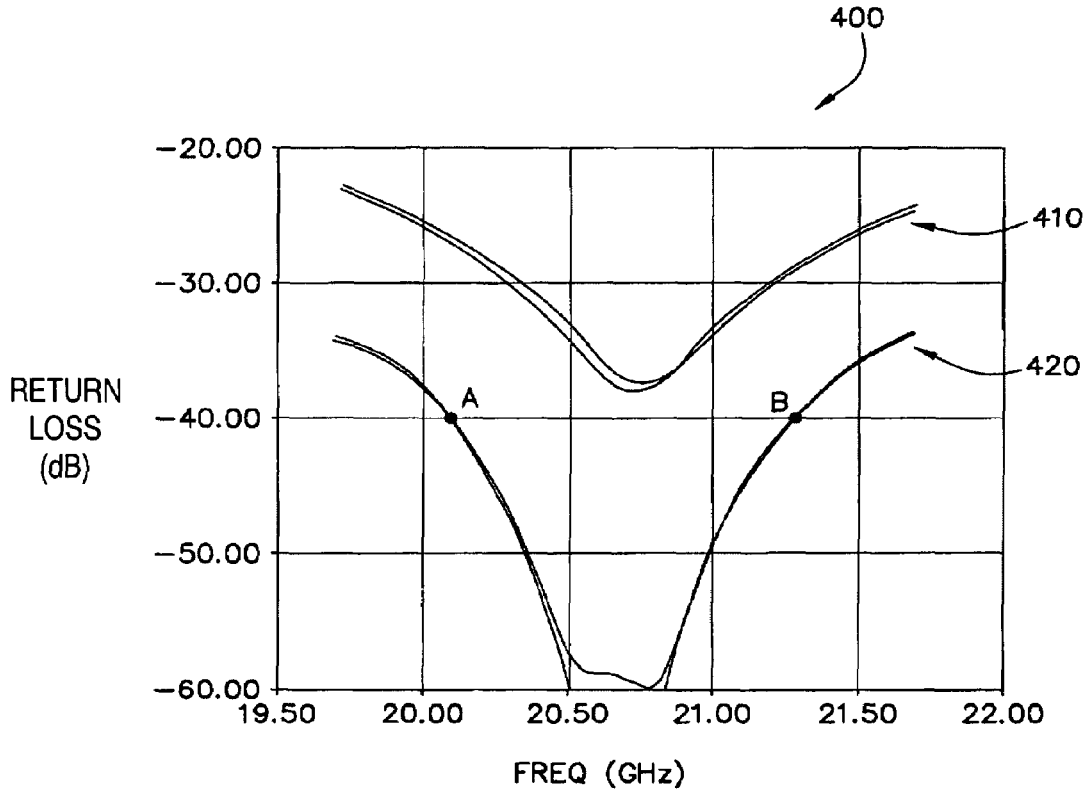
FIG. 4 illustrates a plot of the return loss for a circular waveguide E-bend according to one exemplary embodiment of the invention.

Referring now to FIG. 4, the figure illustrates a plot of the return loss for a circular waveguide e-bend according to one exemplary embodiment of the invention. This figure refers to a circular waveguide e-bend like the one illustrated in FIG. 1. The return loss plot 400 shows frequency in gigahertz on the horizontal axis the and power in decibels (dB) on the vertical axis. The plot trace 410 is of the return loss data for the undesired orthogonal mode, while the plot trace 420 is of the return loss data for the desired dominant mode.

The plot trace 420 of the return loss data demonstrates the bandwidth characteristics of one embodiment of the invention. For example, the plot shows that return loss can be greater than 40 dB for a frequency band from around 20.1 GHz at point A to 21.3 GHz at point B. This is an indication that a significantly small amount of the RF energy is lost or reflected by the circular waveguide e-bend 100 over a full gigahertz or more of operation.

The plot 400 also illustrates that the undesired mode data 410 is substantially suppressed in comparison to the desired mode data 420. However, both signals are well matched.

Figure 5:
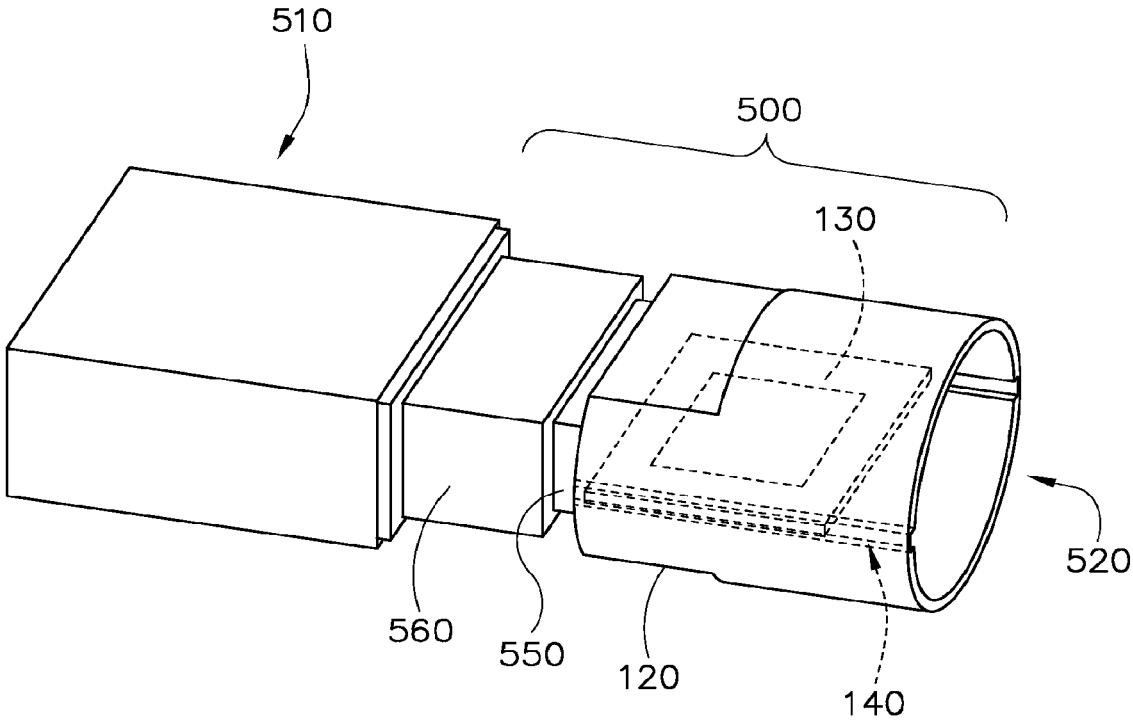
FIG. 5 illustrates a circular waveguide to rectangular waveguide adapter according to one exemplary embodiment of the invention.

Referring now to FIG. 5, the figure illustrates a circular waveguide to rectangular waveguide adapter according to one exemplary embodiment of the invention. Portions of the circular waveguide e-bend 100 of FIG. 1 can also be used to form a circular waveguide to rectangular waveguide adapter 500 that may be useful in testing or interfacing to the circular waveguide e-bend 100 of FIG. 1 or other circular waveguide systems.

A circular waveguide (not illustrated) can be interconnected to a traditional rectangular waveguide 510 (such as a WR51 waveguide) by a circular waveguide to rectangular waveguide adapter 500. The circular waveguide can be connected to the transformer section 120 at the circular interface port 520. The transformer section 120 can interconnect the circular waveguide and a single-mode segment 550 of the circular waveguide to rectangular waveguide adapter 500. A transformer section 120 can be considered a compact quarter-wavelength transformer element as it can transform energy between the circular waveguide and the single-mode segment 550. Since the circular waveguide can support two orthogonal modes of propagation while the single-mode segment 550 only supports one mode, the transformer section 120 can function to couple the desired single mode of propagation from the circular waveguide to the single mode of propagation within the single-mode segment 550.

A resistive mode suppressor 130 within the transformer section 550 can aid in suppressing the undesired mode of propagation within the circular waveguide that is orthogonal to the desired mode. Suppression of the undesired mode of propagation can provide for energy within the single mode segment 550 to couple predominantly with the desired mode within the circular waveguide 520. Longitudinal tracks 140 within transformer section 120 can be provided to position or align mode suppressors 130 within the transformer section 120 of the circular waveguide to rectangular waveguide adapter 500. A conventional quarter wave transformer 560 can transform energy between the single-mode segment 550 and the traditional rectangular waveguide 510.

The exact geometries of the circular waveguide to rectangular waveguide adapter 500 are selected to provide a compact structure that can be machined from a single piece of stock from the outside using an end mill cutter. The exact geometries can also be optimized using High Frequency Structure Simulator (HFSS) or other electromagnetic simulation software to achieve excellent propagation/loss performance, impedance matching, and a substantially flat frequency response.

Figure 6:
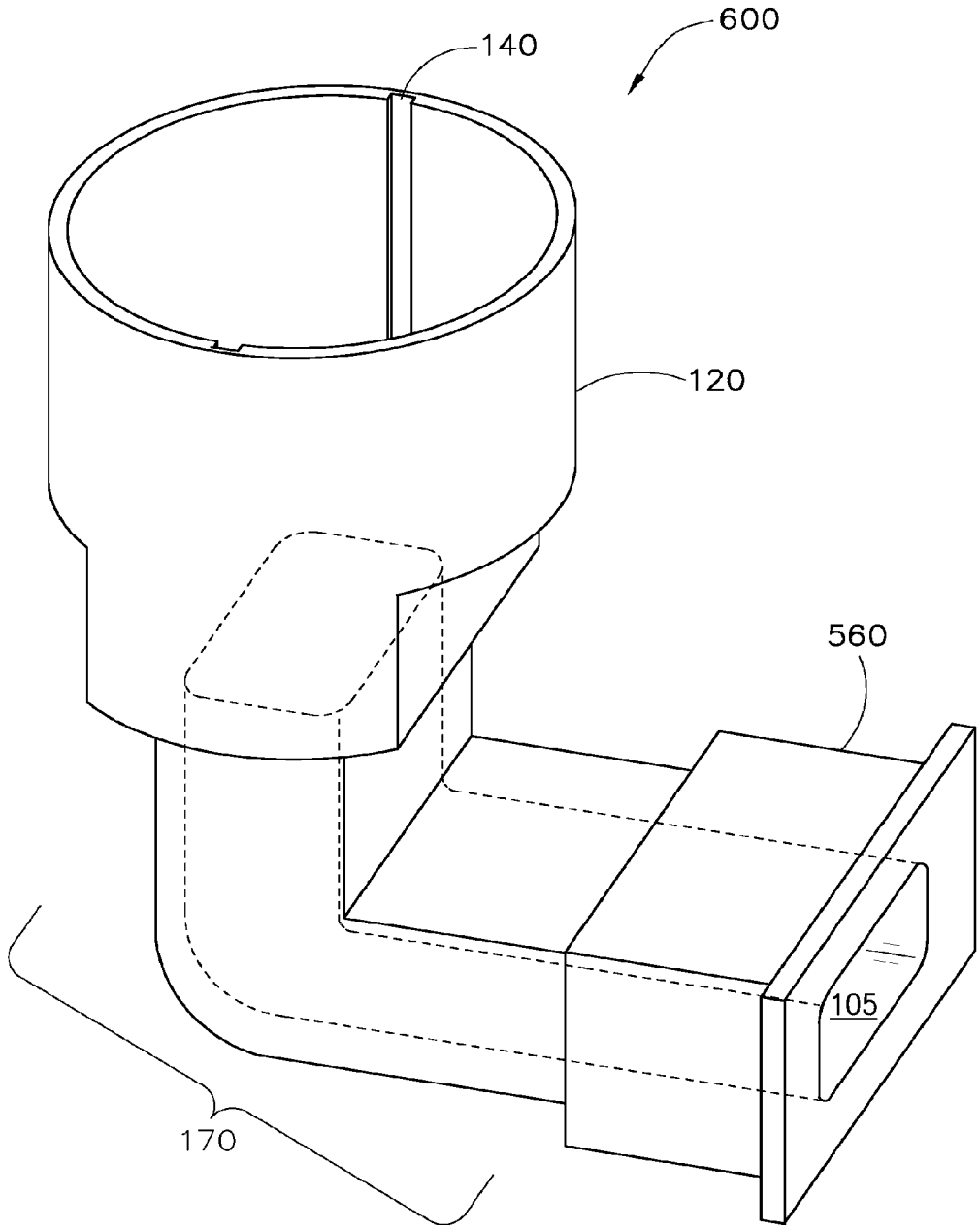
FIG. 6 illustrates a circular waveguide E-bend supporting the interconnection of a circular waveguide to a traditional rectangular waveguide according to one exemplary embodiment of the invention.

Referring now to FIG. 6, the figure illustrates a circular waveguide E-bend supporting the interconnection of a circular waveguide to a traditional rectangular waveguide according to one exemplary embodiment of the invention. The circular to rectangular waveguide E-bend 600 can interconnect a circular waveguide to a traditional rectangular waveguide (such as a WR51 waveguide). Note that FIG. 6 illustrates only the exemplary E-bend and does not show the circular waveguide nor the traditional rectangular waveguide that are being interconnected.

Transformer section 120 of the circular to rectangular waveguide E-bend 600 can be considered a compact quarter-wavelength transformer element for coupling the energy between a circular waveguide and a single-mode segment 170 of the circular to rectangular waveguide E-bend 600. The transformer section 120 can function to couple the desired single mode of propagation from a circular waveguide to the single mode of propagation within the single-mode segment 170.

Within the single-mode segment 170, the wave can be guided through cavity 105. Since the signal within cavity 105 is single-mode, the guided wave can be bent without concern for coupling or combining of energy between multiple modes, as there is only one mode of propagation. A conventional quarter wave transformer 560 can transform energy between the single-mode segment 170 and a traditional rectangular waveguide (not shown in FIG. 6).

A resistive mode suppressor (not shown in FIG. 6) can be positioned within support tracks 140 to aid in suppressing the undesired mode of propagation within the circular waveguide. Suppression of the undesired mode of propagation can provide for energy within the single mode segment 170 to couple predominantly with the desired mode within an attached circular waveguide.

The exact geometries of the circular to rectangular waveguide E-band 600 are selected to provide a compact structure that can be machined from a single piece of stock from the outside using an end mill cutter. The exact geometries can also be optimized using High Frequency Structure Simulator (HFSS) or other electromagnetic simulation software to achieve excellent propagation/loss performance, impedance matching, and a substantially flat frequency response.

Figure 7:
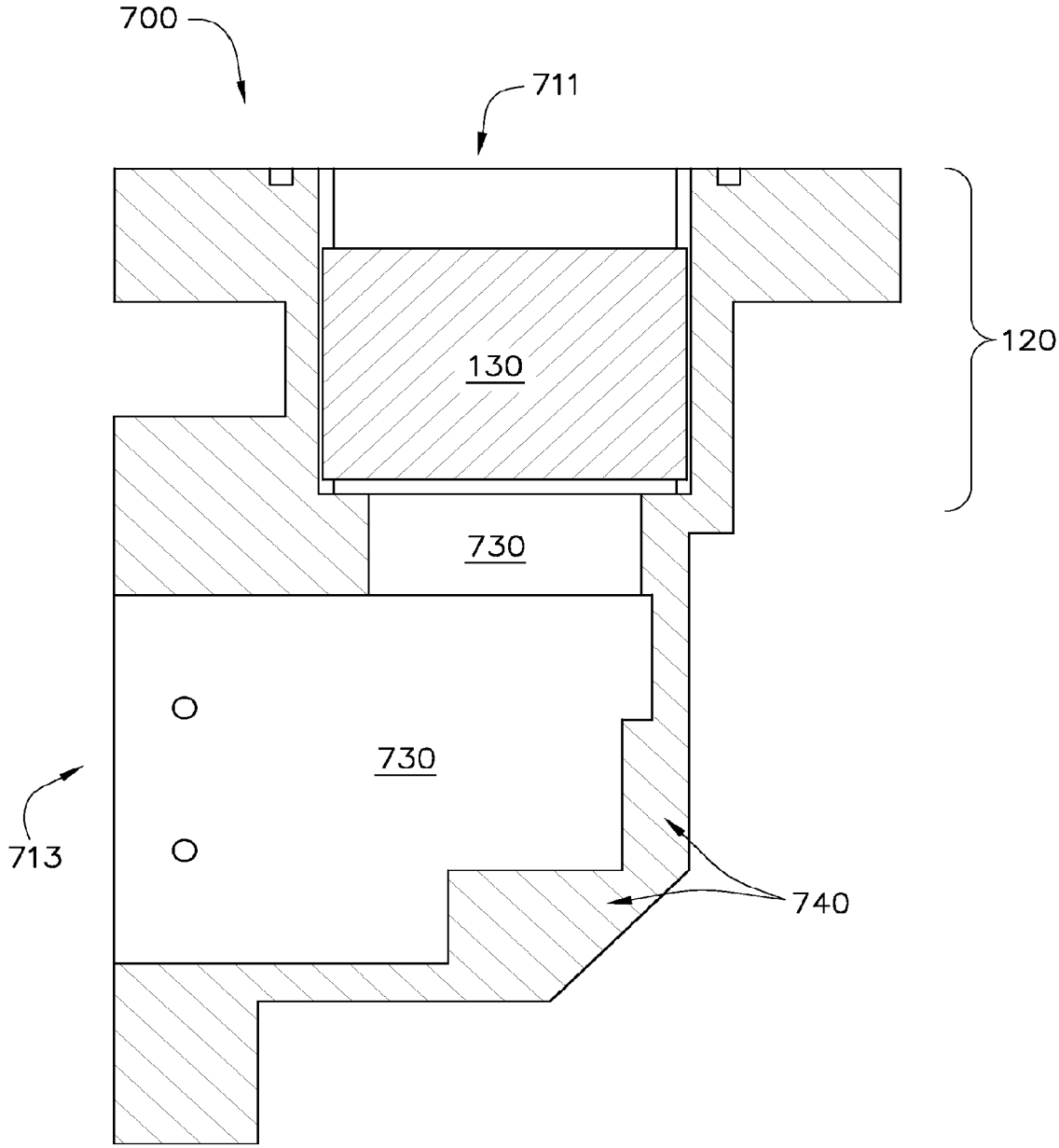
FIG. 7 illustrates a cross-sectional view of an H-bend assembly where a circular waveguide H-bend interconnects a circular waveguide to a traditional rectangular waveguide according to one exemplary embodiment of the invention.

Referring now to FIG. 7, the figure illustrates a cross-sectional view of a circular waveguide H-bend 700 for interconnecting a circular waveguide to a traditional rectangular waveguide according to one exemplary embodiment of the invention. The circular waveguide (not illustrated) can be coupled to the circular waveguide H-bend 700 at the circular interface port 711. The traditional rectangular waveguide (not illustrated) can be coupled to the circular waveguide H-bend 700 at rectangular interface port 713. The traditional rectangular waveguide may be, for example, a WR51 waveguide.

Transformer section 120 of the circular to rectangular waveguide H-bend 700 can be considered a compact quarter-wavelength transformer element for coupling the energy between the circular waveguide and a single-mode segment 730 of the circular to rectangular waveguide H-bend 700. The transformer section 120 can function to couple the desired single mode of propagation from a circular waveguide to the single mode of propagation within the single-mode segment 730. The bend in the single-mode segment 730 can bend the H-plane, or plane of the magnetic field, of the propagated electromagnetic wave. One of ordinary skill in the art will appreciate that an H-bend in a waveguide is such that the broader side of the waveguide can remain in the same plane through the bend. In other words, the electric plane (E-plane) of the wave can remain within the same plane throughout the bend while the magnetic plane (H-plane) can be bent.

Since the single-mode waveguide segment 730 only supports a single mode, the guided wave can be bent without concern for coupling or combining of energy between multiple modes. The scalloped or mitered bend 740 in the single-mode segment 730 can provide for effective H-field bending of the single-mode propagation. The single-mode segment 730 can also provide tapering to couple RF energy to the traditional rectangular waveguide.

A resistive mode suppressor 130 can be positioned within transformer section 120 to aid in suppressing the undesired mode of propagation within the circular waveguide. Suppression of the undesired mode of propagation can provide for energy within the single mode segment 730 to couple predominantly with the desired mode within an attached circular waveguide.

The exact geometries of the circular to rectangular waveguide H-bend 700 may be selected to provide a compact structure that can be machined from a single piece of stock from the outside using a common tool, such as an end mill cutter. The exact geometries can also be optimized using High Frequency Structure Simulator (HFSS) or other electromagnetic simulation software to achieve excellent propagation/loss performance, impedance matching, and a substantially flat frequency response.

Figure 8:
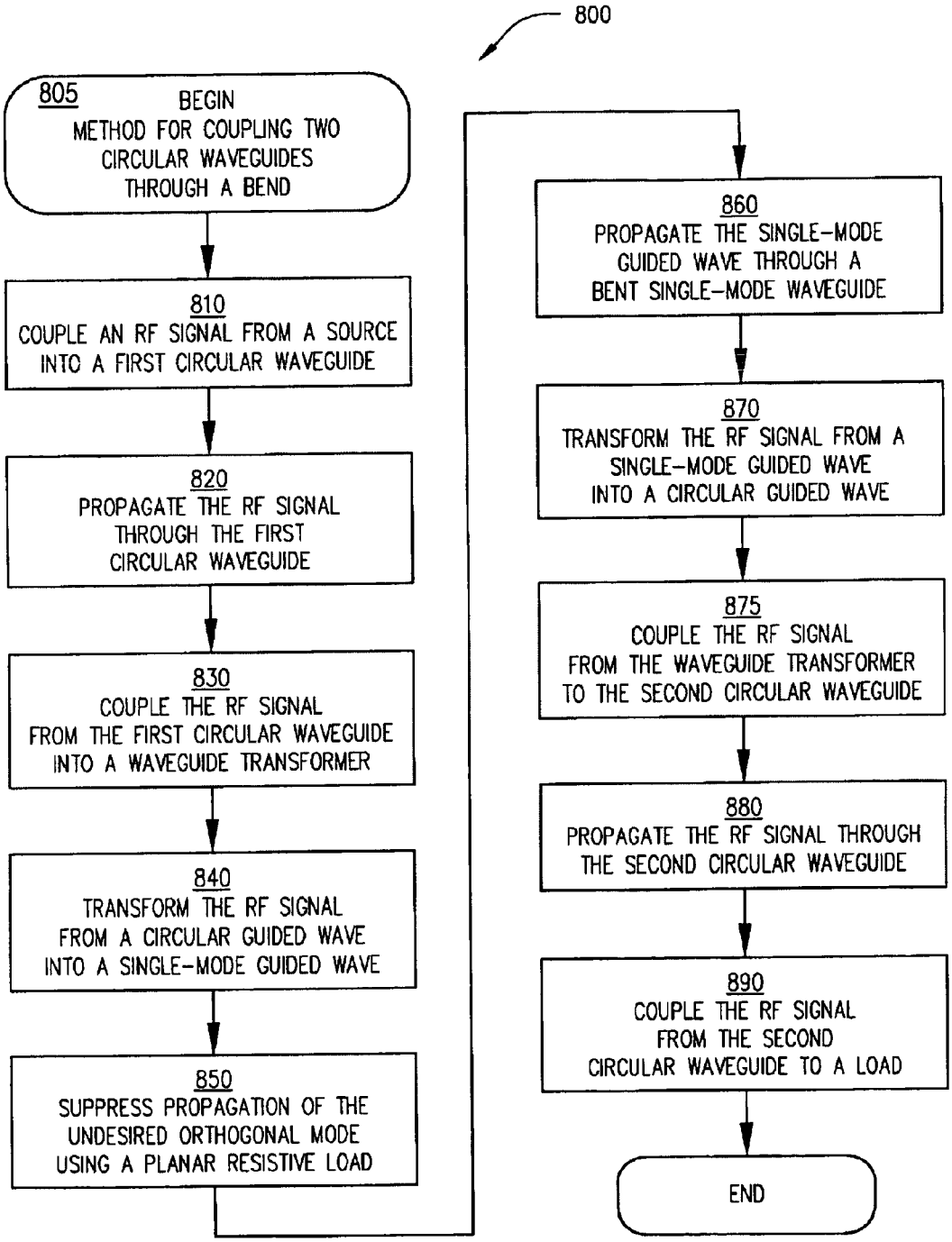
FIG. 8 is a logical flow diagram representing a method for coupling two circular waveguides through a bend according to one exemplary embodiment of the invention.

Referring now to FIG. 8, the figure shows a logical flow diagram representing a method for coupling two circular waveguides through a bend 100,700 according to one exemplary embodiment of the invention. Certain steps in the processes or process flow described in all of the logic flow diagrams referred to below must naturally precede others for the invention to function as described. However, the invention is not limited to the order of the steps described if such order or sequence does not alter the functionality of the invention. That is, it is recognized that some steps may be performed before, after, or in parallel to other steps without departing from the scope and spirit of the invention. One of ordinary skill in the art will appreciate that the method 800 can be practiced in either direction of propagation through a system due to electromagnetic reciprocity.

The method for coupling two circular waveguides through a bend begins at step 805.

Step 810 involves coupling an RF signal from a source into a first circular waveguide. The source of the RF signal can be a signal detector, an antenna, a mixer, an oscillator, a transmission line, another waveguide, a connection to another waveguide, or any other component, device, or system that can be used to feed an RF signal into a waveguide. Step 820 involves propagating the RF signal through the first circular waveguide.

In Step 830, an RF signal is coupled from the first circular waveguide into a waveguide transformer 120. Here, the first circular waveguide is the same as the circular waveguide discussed in relation to Step 810. In Step 840, the waveguide transformer 120 is employed to transform the circular guided wave to a single-mode guided wave. In Step 850, the undesired orthogonal mode from the circular guided wave is suppressed using a planar resistive load, resistive vane, or resistive card 130.

In Step 860, the single-mode guided wave is propagated through a bent single-mode waveguide 170, 730. Such wave bending after reduction to a single-mode guided wave can reduce the undesired effects from mixing of the two orthogonal modes of the circular guided wave.

In Step 870, the RF signal is transformed from a single-mode guided wave back to a circular guided wave. In Step 875, the RF signal transformed in Step 870 is coupled from the waveguide transformer 120 to a second circular waveguide. In Step 880, the RF signal is propagated through the second circular waveguide.

In Step 890, an RF signal is coupled from the second circular waveguide to a load. The load can be a transmitter, antenna, laser, amplifier, a transmission line, another waveguide, a coupling into another waveguide, or any other component, device, or system that an RF signal can be fed into. The method 800 may end or terminate after Step 890.

One of ordinary skill in the art will appreciate that square waveguides may be used in place of the circular waveguides throughout the method 800 since square waveguides can also support two orthogonal modes of propagation.

One of ordinary skill in the art will appreciate that the method 800 need not be limited to the interconnection of two circular (or square) waveguides, but may also be useful in interconnecting one circular (or square) waveguide to any other type of waveguide such as rectangular, circular, square, rounded-rectangular, mitered-rectangular, quasi-rectangular, or otherwise. Method 800 may also be useful for coupling a bend directly into an RF component, source, or load and need not only be operated to couple between two waveguides.

Alternative embodiments of the interconnection and waveguide bending system will become apparent to one of ordinary skill in the art to which the invention pertains without departing from its spirit and scope. Thus, although this invention has been described in exemplary form with a certain degree of particularity, it should be understood that the present disclosure has been made only by way of example and that numerous changes in the details of construction and the combination and arrangement of parts or steps may be resorted to without departing from the spirit or scope of the invention. Accordingly, the scope of the invention is defined by the appended claims rather than the foregoing description.

What is claimed is:

1. A system for providing a bend in a circular waveguide comprising:

a single-mode waveguide;

a first quarter wave transformer coupling the circular waveguide to a first end of the single-mode waveguide;

a mode suppressor disposed within the first quarter wave transformer, the mode suppressor substantially terminating an undesired orthogonal mode of the circular waveguide.

2. The system of claim 1, wherein of the single-mode waveguide has interior corners providing a rounded geometry.

3. The system of claim 1, wherein the mode suppressor comprises a resistive film deposited on a sheet of insulator material.

4. The system of claim 1, further comprising longitudinal channels within the first quarter wave transformer, wherein the mode suppressor is positioned within the longitudinal channels.

5. The system of claim 1, further comprising a second quarter wave transformer coupled to a second end of the single-mode waveguide, the first and second quarter wave transformers operable to respectively couple the circular waveguide and a further circular waveguide to the single-mode waveguide.

6. The system of claim 1, further comprising a second quarter wave transformer coupled to a second end of the single-mode waveguide, the second quarter wave transformer operable to couple a rectangular waveguide to the single-mode waveguide.

7. The system of claim 1, wherein the single-mode waveguide comprises a bend in the E-plane of the waveguide.

8. The system of claim 1, wherein the single-mode waveguide comprises a bend in the H-plane of the waveguide.

9. The system of claim 1, wherein a largest interior diameter of the single-mode waveguide is smaller than a diameter of the circular waveguide.

10. The system of claim 1, wherein the mode suppressor is a resistive mode suppressor.

11. A system for coupling a circular waveguide to a rectangular waveguide comprising:

a single-mode waveguide;

a first quarter wave transformer coupling the circular waveguide to a first end of the single-mode waveguide;

a second quarter wave transformer coupling the rectangular waveguide to a second end of the single-mode waveguide;

a mode suppressor disposed within the first quarter wave transformer, the mode suppressor substantially terminating an undesired orthogonal mode of the circular waveguide.

12. The system of claim 11, wherein of the single-mode waveguide has interior corners providing a rounded geometry.

13. The system of claim 11, wherein the mode suppressor is a resistive mode suppressor.

14. The system of claim 11, further comprising longitudinal channels within the first quarter wave transformer, wherein the mode suppressor is positioned within the longitudinal channels.

15. A method for propagating a radio-frequency signal, the method comprising:

propagating the radio-frequency signal through a first circular waveguide;

coupling the radio-frequency signal from the first circular waveguide to a first quarter wave transformer;

transforming the radio-frequency signal from a circular guided wave to a single-mode guided wave;

suppressing an undesired orthogonal mode of the circular guided wave with a resistive element; and propagating the single-mode guided wave through a bent single-mode waveguide.

16. The method of claim 15, further comprising the steps of coupling the radio-frequency signal from the bent single-mode waveguide to a second quarter wave transformer;

transforming the single-mode guided wave to a circular guided wave with the second quarter wave transformer;

coupling the radio-frequency signal from the second quarter wave transformer to a second circular waveguide; and propagating the radio-frequency signal through the second circular waveguide.

17. The method of claim 15, wherein the step of transforming the radio-frequency signal from a circular guided wave to a single-mode guided wave comprises using the first quarter wave transformer to match the impedance between the first circular waveguide and the bent single-mode waveguide.

18. The method of claim 15, wherein the step of transforming the radio-frequency signal from a circular guided wave to a single-mode guided wave comprises using the first quarter wave transformer to mechanically interconnect the first circular waveguide and the bent single-mode waveguide.

19. The method of claim 15, wherein the step of propagating the single-mode guided wave through a bent single-mode waveguide comprises bending the single-mode guided wave in the E-plane.

20. The method of claim 15, wherein the step of propagating the single-mode guided wave through a bent single-mode waveguide comprises bending the single-mode guided wave in the H-plane.

* * * * *

UNITED STATES PATENT AND TRADEMARK OFFICE

CERTIFICATE OF CORRECTION

PATENT NO. : 7,420,434 B2
APPLICATION NO. : 11/737830
DATED : September 2, 2008
INVENTOR(S) : John C. Hoover It is certified that error appears in the above-identified patent and that said Letters Patent is hereby corrected as shown below:

Column 9, Claim 2, line 8, “wherein of the” should read --wherein the--.
Column 10, Claim 12, line 1, “wherein of the” should read --wherein the--.

Signed and Sealed this

Eleventh Day of November, 2008

JON W. DUDAS
*Director of the United States Patent and Trademark Office*